United States Patent [19]

Sharp

[11] Patent Number: 4,545,621

[45] **Date of Patent: * Oct. 8, 1985**

[54] MINING INSTALLATION EQUIPMENT

[75] Inventor: John Sharp, Doncaster, England

[73] Assignee: Coal Industry (Patents) Limited, London, England

[21] Appl. No.: 532,500

[22] Filed: Sep. 15, 1983

[30] Foreign Application Priority Data

Oct. 15, 1982 [GB] United Kingdom ..... 8229605

[51] Int. Cl.[4] ..... F21C 37/00

[52] U.S. Cl. ..... 299/12; 299/43; 174/69

[58] Field of Search ..... 299/42, 43, 12; 104/194; 174/69

[56] References Cited

U.S. PATENT DOCUMENTS 2,939,905 6/1960 Canfield ..... 174/69
3,433,889 3/1969 DeVries ..... 174/69
4,155,597 5/1979 Pentith ..... 299/42

FOREIGN PATENT DOCUMENTS 1539383 1/1979 United Kingdom .
1542921 3/1979 United Kingdom .
2015452 9/1979 United Kingdom .

*Primary Examiner*—Stephen J. Novosad
*Assistant Examiner*—Michael A. Goodwin
*Attorney, Agent, or Firm*—James C. Wray

[57] ABSTRACT

Services, such as electricity and water, are supplied through conduits to moving machinery such as a long-wall mining machine which moves along a conveyor or other fixed path. A channel having an open mouth which is flexibly sealed is disposed alongside the path and contains supply conduits for the machine. A sleeve projects through the channel seals into the body of the channel and guides the conduits to the machine. A gas may be fed to the machine via the channel and sleeve. As the machine moves the conduits bend over themselves.

15 Claims, 4 Drawing Figures

MINING INSTALLATION EQUIPMENT

This invention relates to moving machinery equipment particularly, but not exclusively, to equipment in a longwall mining installation of the kind in which a machine is arranged to travel along a conveyor, the machine receiving services from a plurality of conduits disposed alongside the conveyor, and to a method of operating such equipment. The invention can also be applied, for example, to a machine tool supplied with services such as oil and electricity which traverses a prescribed path along a workpiece.

In mining installations, particularly coal mines, where longwall faces are being cut a mining machine which traverses a conveyor has to receive power from a trailing cable. If dust suppression is being used it is necessary also for water to be supplied through a trailed hose. These trailing cables and conduits are a potential source of trouble since they are liable to catch or snag in equipment along the face. To overcome the problems it is the practice to lay the cables in a channel which runs along the goaf side of the conveyor and to retain them in the channel with flexible gates or arms which close across the mouth of the channel at spaced intervals.

In order to give added protection to the cable, which if damaged may cause dangerous sparks to be emitted, and to the hose which may eject a high pressure jet of water if punctured which can be extremely dangerous to any personnel in the vicinity, it has been the practice also to enclose at least part of the cables and conduit in an articulated metal or nylon cable handler which gives mechanical protection. Air is not provided to the machine directly, but may be induced to flow from the chock area into the drum area to dilute concentrations of methane. This air itself may contain methane.

An alternative pickup means for transferring power from alongside the conveyor to the machine travelling on it has been proposed, for example in British Patent Specification Nos. 1,508,785, 1,508,788, 1,518,542, 1,534,382 and 1,542,921, which describe a system offered under the Trade Name 'Surepower'. This system basically comprises electrical conductors or bus-bars laid in a channel on the goaf side of the conveyor and a pantograph affixed to the cutting machine which travels along the conveyor and extends into the channel to make electrical contact with the conductors. Current is picked up from the conductors as the machine moves along the conveyor and there is a consequential constant supply of electric current to the machine. To avoid dirt and moisture fouling the conductors and inhibiting the quality of the electrical contact made between the pantograph and the conductors various forms of sealing means are suggested to close the mouth of the channel in which the conductors are located. These sealing means include flexible flaps, tubes and inflated conduits. The sealing means have been found in practice not to be fully effective and corrosion of the conductors resulting in poor current transfer has occurred.

The system has also proposed, for example in British Pat. No. 1,539,838, to incorporate a subsidiary channel in which a fluid, such as water, is pumped and which is picked up by a separate pantograph for supply to dust suppression means on the machine or to provide a cooling medium for parts of the machine. Again in practice the proximity of the water and electrical supply conduits with their problems of extraction via pantographs has proved a source of problems.

It is an object of the present invention to provide equipment for feeding supplies to a moving machine which is safer, more practical and less prone to damage than has hitherto been available.

According to a first aspect of the present invention moving machinery equipment of the kind in which a machine is arranged to travel along a prescribed path, the machine receiving services from a plurality of conduits disposed alongside the said path, comprises a channel member having an open side sealed by flexible sealing means arranged to extend parallel to one side of the path, sleeve means connected to the machine and extending into the channel member through the flexible sealing means and conduit means connected to the machine extending through the sleeve means into the channel member and being longitudinally displaced therein, the conduit means being a sufficiently loose fit in the channel member and sleeve means to leave a passage for the supply of a gas through the said channel member and sleeve means.

The conduit means, which may be cables or pipes, are preferably noncircular in cross-section and may be elliptical or rectangular so as to bend to form a loop with their largest dimensions of cross-section lying on top of each other.

The channel member is preferably made of or lined with a material which presents a smooth surface. A suitable material is a polymer plastic, such as neoprene, and the member is preferably formed with no projections on its internal surface.

The open mouth of the channel member may be sealed by a longitudinally extending pair of abutting flexible tubes, or a pair of overlapping or abutting flaps.

A blower may be incorporated in the installation for blowing air or a gas through the channel member and sleeve means to the machine. Any joints in the channel or member are preferably flexible, airtight and internally smooth.

The conduit means may, in a variant of the installation, be connected to the machine separate from the sleeve means.

The machinery is preferably a mining machine and the prescribed path is a conveyor along which the machine moves. The conveyor may be part of a longwall mining installation with the channel member extending along the goaf side of the conveyor.

According to another aspect of the present invention a method of supplying services to moving machinery equipment of the kind in which a machine is arranged to move along a prescribed path and to receive services from a series of conduits disposed in a channel member located alongside the said path, includes feeding conduit means carrying services for the machine through sleeve means extending into the channel member through an open side thereof, closing said open side with flexible sealing means and causing the sleeve means to open said means as it is moved by the machine along the path, and feeding a gas through said channel member and sleeve means to the machine.

The method may be applied to the supply of services in a longwall mining installation where a coal or other mineral cutting machine moves along a conveyor set parallel to a face being cut and draws services from the channel member disposed along one side of the conveyor.

In order that the invention may be readily understood, moving machinery equipment embodied in a mining machine installation in accordance therewith and using the method thereof will be described, by way of example only, with reference to the accompanying drawings.

In the drawings FIG. 1 shows a schematic layout of a coal mining longwall installation; and FIG. 2 shows in detail the connection between a machine and conveyor installation.

Figure 1:
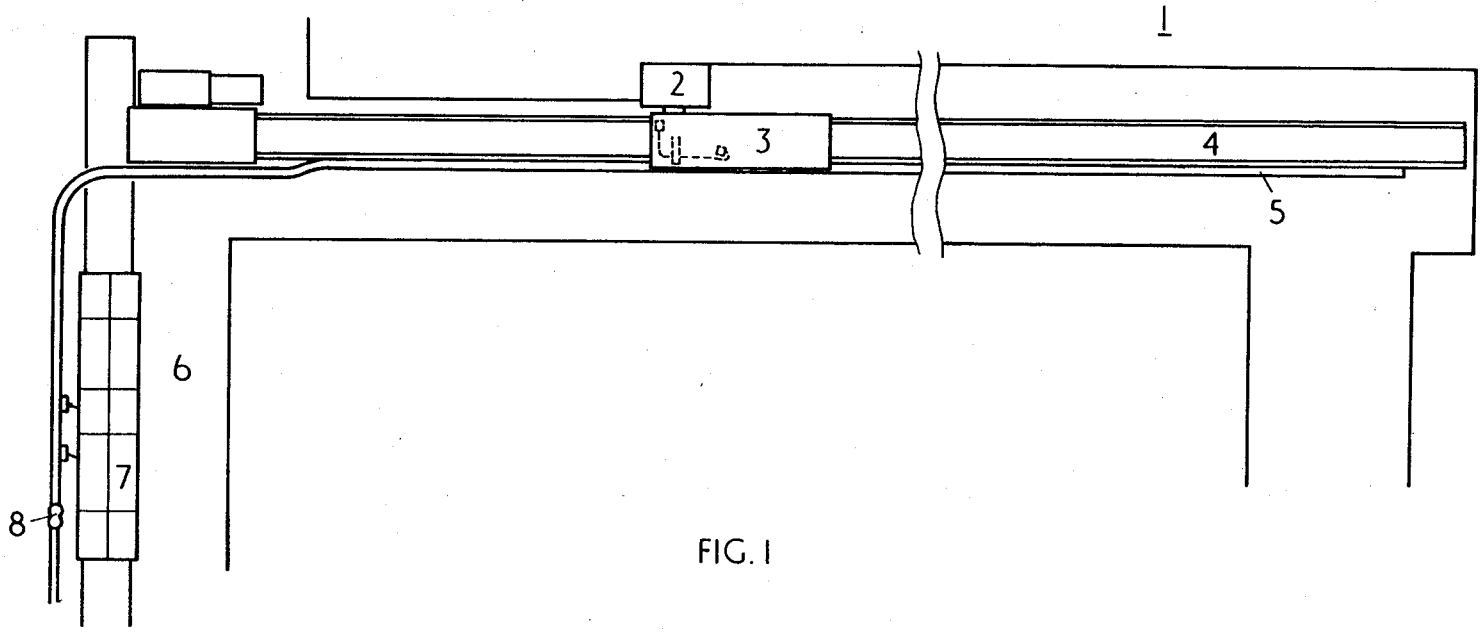

Referring first to FIG. 1, this shows a longwall face of coal 1 which is cut by a cutter drum 2 of a shearer machine 3 which traverses along the face of a conveyor 4. On the goaf side of the machine a channel member 5 lies adjacent the conveyor and attached thereto. One end of this channel member extends into a roadway 6 where services are fed into it from a gate end box pantechnicon source 7. A blower 8 blows fresh (methane free) air into the channel member.

Figures 2, 3, 4:
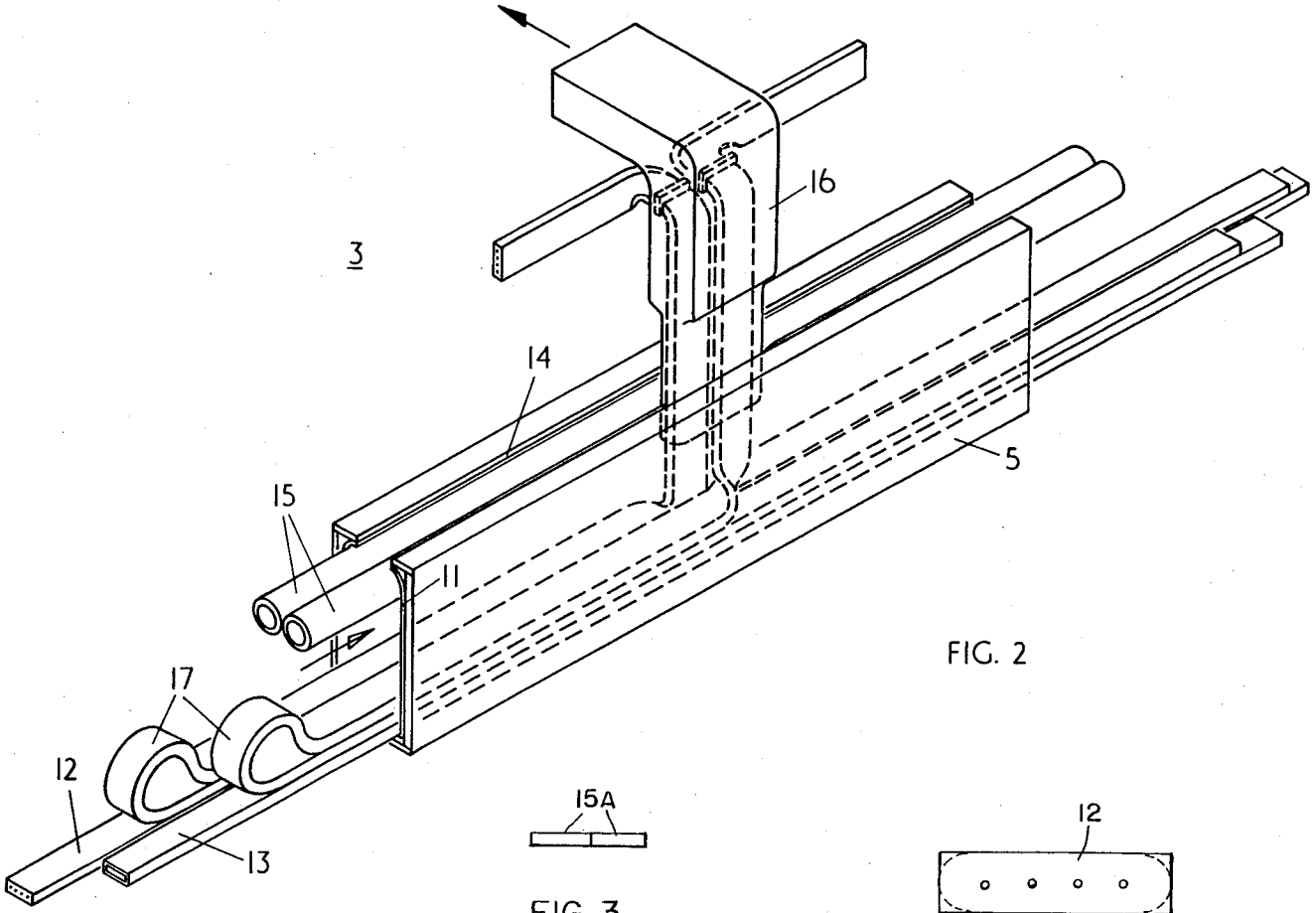
FIG. 3 shows a cross-sectional view of abutting flaps used in place of tubes 15 shown in FIG. 2.
FIG. 4 shows a cross-sectional view of a conduit means with rounded edges shown in broken lines.

Referring now also to FIG. 2 the channel member 5, a section of which only is shown, is seen as having a lining material 11 which is of neoprene and presents a smooth internal surface to a cable 12 and a water hose 13 forming a supply conduit means both of which are of substantially rectangular cross-section. The open mouth 14 of the channel member 5 has a pair of flexible sealing tubes 15 fixed along each side so that they abut longitudinally in the centre of the opening.

A sleeve 16 is connected to and extends from the machine 3 and depends into the channel member 5 through the sealing tubes 15. The sleeve has tapered ends along the line of the channel to prevent large gaps opening in the sealing means 15. Alternative sealing means may be provided, such as the abutting flaps 15A shown in FIG. 3. The cable 12 and hose 13 which are readily flexible extend up through the sleeve 16 and are connected as appropriate to the machine 3. The cable 12 and hose 13 are a free fit in the sleeve 16 and the channel member 5 to allow a free passage of air from blower 8 to blow along the whole length of the channel member and to reach the machine 3 through the sleeve 16.

In use air is supplied to the machine via channel member 5 and sleeve 16, water through hose 13 and power through cable 12. As the machine moves along the conveyor 5 the sleeve forces the sealing tubes 15 open. They immediately close up again after the sleeve has passed on account of their flexible nature. As the sleeve 16 moves it pulls the cable 12 and hose 13 along, these conduits fold onto themselves as shown at 17 to form loops. Since the conduits are non-circular and are laid with their maximum dimension parallel to the base of channel member 5 they fold easily onto themselves and do not fall about in the channel or risk entanglement or being brought to a sharp bend which might cause ruptures. High pressure water can at all times be fed through hose 13. The smooth lining ensures the conduits are able easily to move within the channel member without any risk of snagging. Adjacent longitudinal sections of channel member 5 are joined by flexible joints (not shown) which are designed to be substantially air and gas tight.

It will be appreciated that the invention enables services to be efficiently and safely provided directly to the machine since if any fault occurs in the cable or hose it will be contained safely within the sleeve or channel and there will be no risk of sparking or poor electrical contact due to an hostile atmosphere. Furthermore, air supplied to the machine can be drawn from a methane-free source and used for cooling purposes of the cable and hose if required.

The invention, although described for a mining installation can also be applied, with obvious adaptations to ensure the safe supply of services to any machinery travelling along a prescribed path.

I claim:

1. Moving machinery equipment of the kind in which a machine is arranged to travel along a prescribed path, the machine being arranged to receive services from a plurality of conduits disposed alongside the said path, comprising a channel member, flexible sealing means provided on the channel member, the channel member being disposed to extend parallel to the said path, sleeve means connected to the machine and extending into the channel member through the flexible sealing means, and sheathed substantially rectangular conduit means longitudinally disposed within the channel member, and being connected to the mining machine extending through the sleeve means into the channel member, the conduit means being a sufficiently loose fit in the channel member and sleeve means to leave a passage for the supply of gas through said channel member and sleeve means, whereby movement of the machine causes the conduit means to form a loop within the channel member by bending about its largest dimension.

2. Equipment as claimed in claim 1 in which at least one of the conduit means is rectangular in cross-section.

3. Equipment as claimed in claim 1 in which the channel member is formed with substantially no internal projections or protuberances.

4. Equipment as claimed in claim 1 in which the channel member is lined with a smooth-surfaced material.

5. Equipment as claimed in claim 4 in which the material is neoprene.

6. Equipment as claimed in claim 1 in which the sealing means comprises a pair of longitudinally extending flaps.

7. Equipment as claimed in claim 1 in which one of the conduit means is hollow.

8. Equipment as claimed in claim 1 and including blower means for blowing air or another gaseous medium into the channel member.

9. Equipment as claimed in claim 1 in which the channel member is comprised of a plurality of longitudinal sections joined by flexible joint means, the flexible joint means being substantially air tight.

10. Equipment as claimed in claim 1 wherein the conduit means have rounded edges.

11. Mining installation equipment in a longwall mining installation of the kind including a longwall mining machine, a conveyor and associated conduit receiving channel member, the mining machine being arranged to travel along the conveyor, a plurality of conduits located in the channel member and connected to the machine, flexible sealing means on the channel member arranged to enclose the said conduits in the channel member, sleeve means connected to the mining machine and extending into the channel member through the flexible sealing means and conduit means, the conduit means being connected to the mining machine and arranged to extend through the sleeve means into the channel member and longitudinally displaced therein, the said conduit means being a sufficiently loose fit in the channel member and sleeve means to leave a passage for the supply of a gas through the said channel member and sleeve means, the conduit means being sheathed and substantially rectangular, and being disposed longitudinally within the channel member, whereby the movement of the machine causes the conduit means to form a loop within the channel member by bending about its largest dimension.

12. A method of supplying services to moving machinery equipment of the kind in which a machine is arranged to travel along a prescribed path and to receive services from a series of conduits disposed in a channel member located alongside the said path, including the step of feeding conduit means carrying services for the machine through sleeve means extending into the channel member through a side thereof, closing said side with flexible sealing means and causing the sleeve means to open said sealing mens as it is moved by the machine along the conveyor, and feeding a gas through said channel member and sleeve means to the machine, wherein the conduit means is sheathed and substantially rectangular, and disposed longitudinally within the channel member, whereby movement of the machine causes the conduit means to form a loop within the channel member by bengind about it largest dimension.

13. A method as claimed in claim 12 including the step of lining the channel member with a smooth-surfaced material.

14. A method of supplying services to a longwall mining installation of the kind in which a mining machine is arranged to move along a conveyor and to receive surfaces from a series of conduits disposed in a channel member located alongside the conveyor, includes feeding conduit means carrying services for the machine through sleeve means extending into the channel member through an open side thereof, closing said open side with flexible sealing means and causing the sleeve means to open said means as it is moved by the machine along the conveyor, and feeding a gas through said channel member and sleeve means to the machine, wherein the conduit means is sheathed and substantially rectangular, and disposed longitudinally within the channel member, whereby movement of the machine causes the conduit means to form a loop within the channel member by bending about its largest dimension.

15. A method as claimed in claim 14 including a blower, the blower being connected to the channel member to feed the said gas therethrough by blowing.

* * * * *